US008721168B2

(12) United States Patent
Nadler et al.

(10) Patent No.: US 8,721,168 B2
(45) Date of Patent: May 13, 2014

(54) HOMOGENIZER DEVICE HAVING A ROTOR AND AN ADVANCE WHEEL (INDUCER SCREW) THAT CAN ROTATE OPPOSITE TO THE ROTOR AND A COUNTER-CURRENT ROTOR THAT CAN ROTATE OPPOSITE TO THE ROTOR

(75) Inventors: Urs Nadler, Rheinfelden (CH); Uwe Klaumünzner, Münstertal (DE); Sascha Lais, Lörrach-Haagen (DE); Hans-Ruedi Zimmermann, Thervil (CH)

(73) Assignee: FrymaKoruma AG, Rheinfelden (CH)

( * ) Notice: Subject to any disclaimer, the term of this patent is extended or adjusted under 35 U.S.C. 154(b) by 1091 days.

(21) Appl. No.: 12/085,275

(22) PCT Filed: Feb. 16, 2006

(86) PCT No.: PCT/IB2006/000734

§ 371 (c)(1),
(2), (4) Date: Mar. 17, 2009

(87) PCT Pub. No.: WO2007/060501

PCT Pub. Date: May 31, 2007

(65) Prior Publication Data

US 2009/0225624 A1 Sep. 10, 2009

(30) Foreign Application Priority Data

Nov. 23, 2005 (DE) ..... 20 2005 018 432 U

(51) Int. Cl.
*B01F 7/00* (2006.01)

(52) U.S. Cl.
USPC ..... 366/296; 366/315; 366/317; 366/295

(58) Field of Classification Search
USPC ..... 366/315, 316, 317, 290, 295, 296, 366/156.1, 157.1, 157.4
See application file for complete search history.

(56) References Cited

U.S. PATENT DOCUMENTS 3,996,012 A * 12/1976 Zucker ..... 422/211

(Continued)

FOREIGN PATENT DOCUMENTS

| | | |
|---|---|---|
| DE | 34 17 242 | 11/1985 |
| DE | 202 20 442 | 9/2003 |
| DE | 103 20 739 | 10/2004 |

(Continued)

OTHER PUBLICATIONS

International Search Report.

*Primary Examiner* — Amjad Abraham
*Assistant Examiner* — Ninh Le
(74) *Attorney, Agent, or Firm* — Collard & Roe, P.C.

(57) ABSTRACT

In the case of a homogenizer device (100) for dispersing and/or homogenizing liquid to viscous substances, having a container (110) having one or more openings for introducing the substances to be processed, which has an opening for feeding the substances into a processing unit (120) in the central region of its bottom, which opening contains two gear rims (130, 140), which can be driven independent of one another, are disposed concentrically and configured in circular shape, and are separated from one another by way of a predetermined interstice, whereby the substances are guided from a central region, through the interstice, into a peripheral region of the gear rims, formation of cavitation is prevented, to the greatest possible extent, in that a conveyance device (150) is additionally provided in the processing unit (120), which device conveys the substances in the direction of the gear rims (130, 140), under pressure.

19 Claims, 6 Drawing Sheets

(56) References Cited

U.S. PATENT DOCUMENTS

Figure 1:
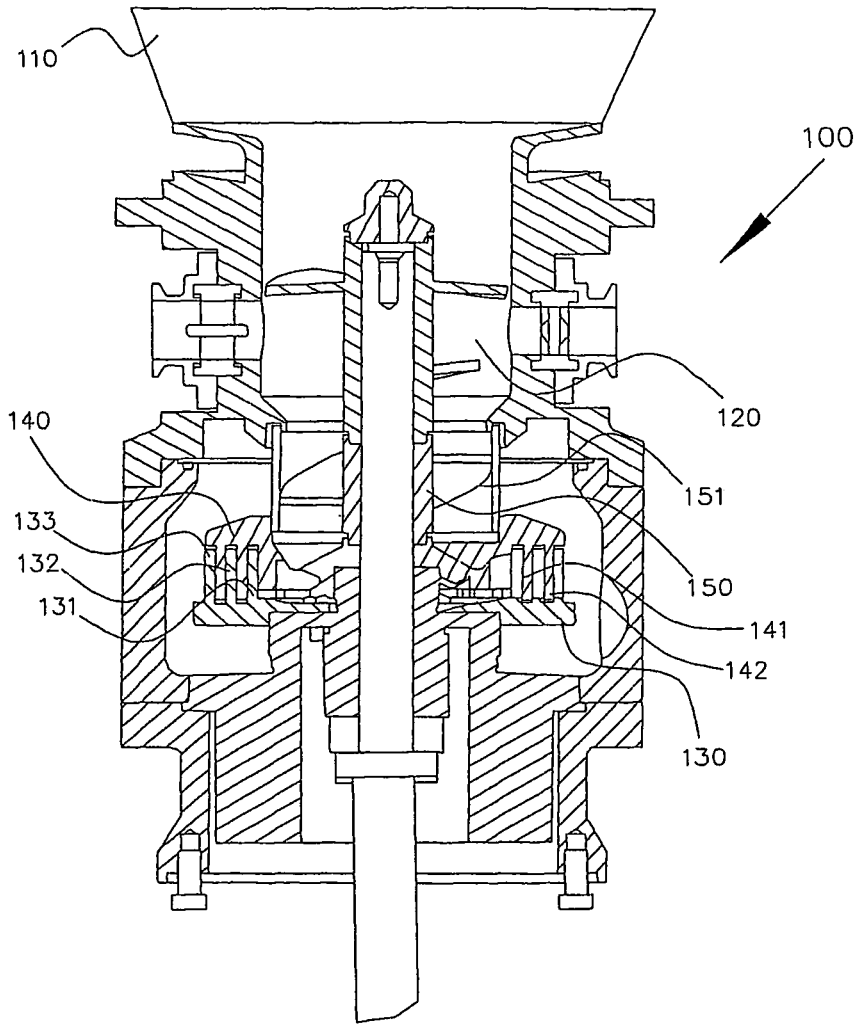

| | | | | |
|---|---|---|---|---|
| 5,356,945 | A * | 10/1994 | Werner et al. | 521/159 |
| 7,325,966 | B2 | 2/2008 | Gassenschmidt | |
| 2003/0202421 | A1 | 10/2003 | Ding | |
| 2006/0016922 | A1 * | 1/2006 | Klaumunzner | 241/97 |

FOREIGN PATENT DOCUMENTS

| | | | | |
|---|---|---|---|---|
| EP | 0 290 033 | | 11/1988 | |
| EP | 1 155 733 | | 11/2001 | |
| EP | 1197260 | A1 * | 4/2002 | B01F 3/12 |
| WO | WO03066203 | * | 8/2003 | B01F 11/02 |

* cited by examiner

HOMOGENIZER DEVICE HAVING A ROTOR AND AN ADVANCE WHEEL (INDUCER SCREW) THAT CAN ROTATE OPPOSITE TO THE ROTOR AND A COUNTER-CURRENT ROTOR THAT CAN ROTATE OPPOSITE TO THE ROTOR

CROSS REFERENCE TO RELATED APPLICATIONS

This application is the National Stage of PCT/IB2006/000734 filed on Feb. 16, 2006, which claims priority under 35 U.S.C. §119 of German Application No. 20 2005 018 432.2 filed on Nov. 23, 2005. The international application under PCT article 21(2) was not published in English.

The invention relates to a homogenizer device for dispersing and/or homogenizing liquid to viscous substances, having a container having one or more openings for introducing the substances to be processed, which container has an opening for feeding the substances into a processing unit in the central region of its bottom, which opening contains two gear rims, which can be driven independent of one another, are disposed concentrically and configured in circular shape, and are separated from one another by way of a predetermined interstice, whereby the substances are guided from a central region, through the interstice, into a peripheral region of the gear rims.

Devices of the type stated initially are used in the state of the art to homogenize viscous substances, at a high speed of rotation of the gear rims in question. Centrifugal forces that act on the substances to be processed are connected with the high speeds of rotation of the gear rims, which forces bring about a pump effect, which in turn leads to the formation of a partial vacuum that conveys the substances. However, the known devices have the disadvantage that cavities form in the substances as the partial vacuum develops, which cavities limit the pump output, starting at a critical speed of rotation, even if the speed of rotation is increased further, and, on the other hand, promote corrosion and premature material wear.

It is therefore the task of the invention to create a homogenizer device with which the formation of cavitation is prevented, to the greatest possible extent, at high efficiency.

For a device of the type stated initially, this task is accomplished in that a conveyance device is additionally provided in the processing unit, which device conveys the substances in the direction of the gear rims, under pressure.

Preferred embodiments of the invention are the object of the dependent claims.

In the case of the device according to the invention, the result achieved by the characteristic that a conveyance device is additionally provided in the processing unit, which device conveys the substance in the direction of the gear rim, under pressure, is that such a strong pressure builds up in the processing unit that formation of cavities in the substances to be processed is reliably prevented.

The homogenizer device according to the invention functions on the basis of a gear-crown dispersion device. This is installed in a vacuum processing system, according to the invention.

In order to make the invention clear, the systematic function of a vacuum processing system will be explained in greater detail below:

Vacuum processing systems serve to process emulsions and suspensions in batches, i.e. in the form of subdivided, discrete amounts, in order to produce homogenized liquids having different viscosity, from liquid to viscous. Generally, in this connection, continuous processing is carried out in a work container, for a predetermined segment of time. For this purpose, the interior of the work container is adjusted to a local gas pressure of between 300 mbar and 700 mbar, depending on the consistency of a product to be processed; this is also referred to as a corresponding technical vacuum. Because of the partial vacuum that forms in the work container, the components of the product to be processed are drawn directly into the vacuum processing system, in liquid or powder form.

Taking parameters such as product temperature, heating times, and cooling times into consideration, the product is processed until the required quality is reached. Afterwards, the product has to be bled. This is done in that the vacuum in the system is reduced even further, down to gas pressure values that lie below 80 mbar, in practical situations.

Most products contain water or other liquids whose boiling point at normal pressure (1000 mbar) lie at about 100° C. Because of the technical vacuum prevailing in the work container, however, the boiling point of these liquids drops. If a production method of a product having a high water content requires processing at temperatures above 85° C., for example, a pre-selected value of the technical vacuum of 500 mbar, for example, can then only be reached with very great effort, since the boiling point of water lies at 81° C. at a pressure of 500 mbar, and thus steam will constantly flow into the work container and increase the gas pressure in the work container. On the other hand, vapor bubbles form in the product to be processed; the corresponding phenomenon is called cavitation.

In the case of centrifugal pumps known in the state of the art, the cause of cavitation is generally a local pressure decrease, particularly in the region of a blade channel entry of an impeller, whereby regions of such pressure decreases are unavoidably formed when the conveyed liquid flows around the blade entry edges, and when energy is transferred from the impeller blades to the conveyed liquid. However, cavitation can also occur in other regions of a local pressure decrease in a pump, such as at the entry edges of guide wheel blades, housing tongues, split rings, etc., for example.

In the case of gear rim dispersion devices, the rotor takes on the pumping or conveying function, in that the product is drawn out of the shear gap by way of the tool geometry (pump vanes, etc.). This means that a partial vacuum occurs in the shear gap, because of the suction effect and because of the inertia of the product, which is particularly noticeable in the case of products having higher viscosity. This partial vacuum has the pressure of the technical vacuum prevailing in the container superimposed on it.

Starting from a speed of rotation of the rotor of approximately 2500 rpm, the throughput asymptotically approaches a limit value. This is due to the fact that rotor/stator dispersion devices are part of the group of flow machines and function like centrifugal pumps. In the case of rotor/stator dispersion devices, too, the most frequent cause of cavitation is found in rapidly moving objects in a processing fluid, such as impellers or propellers.

In accordance with Bernoulli's Law, the pressure in a liquid is all the lower, the higher its flow velocity. If the flow velocity is so high that the pressure drops below the evaporation pressure of the liquid, it passes over into its gaseous state, and cavitation occurs. In the corresponding evaporation process, gas bubbles form in the liquid. The spatial region taken up by a pre-determined amount of evaporated, i.e. gaseous water is about a thousand times greater, in a normal pressure range of a technical vacuum, than the spatial region taken up by the same amount of liquid water. For centrifugal pumps, the important relationship has been empirically determined, in this connection, that when the gas proportion in a liquid to be conveyed by the centrifugal pump increases, the corresponding conveyance characteristic of the centrifugal pump decreases, i.e. the effectiveness of the pump is reduced by cavitation.

In the case of gear rim dispersion devices, this situation is in contrast to the efforts to operate these devices at higher and higher circumference speeds, to improve the shear energy. A disadvantage of the formation of vapor bubbles results from the fact that droplets to be broken up can escape in the shear gap, into the vapor bubbles that form empty spaces in the product. This circumstance has a negative effect on the efficiency of a dispersion device. The causes for this will be briefly outlined below:

Immediately after the product is hurled out of the dispersion zone by centrifugal forces that act on the product because of the high rotor speed of rotation, the pressure downstream increases due to the pump effect of the rotor, since the rotor now assumes a pump property.

In this connection, pipe friction losses and flow losses, for example, have to be overcome. As a function of the rotor diameter, rotor speed of rotation, and geometry of the rotor (geometry of the pump vanes affixed to the rotor), pressures up to 4 bar occur in this connection.

As soon as the pressure exceeds a certain threshold value, the evaporation process comes to a stop again, and the steam that has formed in a cavitation bubble condenses in the region of the outside wall of the cavitation bubble, and the cavitation bubbles that have already formed suddenly collapse. The liquid fills the volume of the collapsed cavitations again, and flows back into these spatial regions with high energy, in the manner of an implosion, thereby causing extreme pressure surges to occur in the liquid, even though this happens only for a short period of time, which surges can assume magnitudes of several thousand bar. If the vapor bubbles are in the vicinity or directly in the region of fixed surfaces such as impeller blades, for example, a stochastically oriented liquid jet called a microjet is formed during the implosion, which, with a certain probability, will impact the surface of an impeller blade at high speed, and erode the latter, for one thing, and also cause it to vibrate, due to sudden pressure stress, and thereby exposes it to severe material stress. In this connection, crater-shaped material wear occurs as the result of cavitation, among other things.

It is therefore a general aim of the invention to keep the formation of cavitation as low as possible, since the damage caused by it in vacuum processing systems is greater than any possible benefit.

In order to prevent cavitation, it is provided, according to the invention, that the following goals are generally implemented:

- formation of vapor bubbles in the shear gap is to be avoided,
- inherent pump output/inherent conveyance output of the gear rim dispersion device is to be reduced,
- the tool geometry of the individual gear rims of the dispersion device is to be configured to the effect that a pressure can build up in the flow direction,
- the NPSH value of the dispersion device is to be reduced.

According to a first preferred embodiment of the device according to the invention, it is provided that the conveyance device is disposed upstream from the gear rims.

According to another preferred embodiment of the device according to the invention, it is provided that the conveyance device is configured as an inducer screw or advance screw or advance wheel having two to four partly overlapping vanes. Preferably, in this connection, three partly overlapping vanes are provided.

The vanes of the inducer screw preferably overlap in an angle range of 50° to 80°, particularly in an angle range of 65°, whereby the vanes preferably have a pitch of about 20% to 40%, and particularly a pitch of about 30%.

According to another preferred embodiment of the device according to the invention, it is provided that the inducer screw is disposed within a hollow cylinder through which the substances to be processed pass.

According to an important preferred embodiment of the device according to the invention, it is provided that the two gear rims can be driven to rotate opposite to one another. Independent of the mode of operation, the two gear rims preferably each have a plurality of concentric rows of teeth, whereby a first group of rows of teeth acts as a rotor, and a second group of rows of teeth acts as a counter-current rotor that can be driven to rotate opposite to the rotor. In this connection, the counter-current rotor is preferably provided with an inner and an outer row of teeth, which are disposed concentric to one another. The counter-current rotor may even contain three rows of teeth, preferably disposed concentric to one another.

In order to prevent cavities from forming, particularly in the region of the gear rims, it is provided, according to other important embodiments of the invention, that the teeth of at least one of the rows of teeth of the counter-current rotor are disposed at an angle that differs from 0°, with reference to the tangent of the row of teeth in question, in such a manner that a liquid pressure is produced in the direction towards the center of the row of teeth. By means of the pressure generated in the direction towards the center of the row of teeth, cavity formation is prevented in very effective manner precisely at the location at which the greatest problems in this regard have occurred in conventional devices. In this connection, the teeth of the inner row of teeth, in particular, can be disposed at an angle that differs from 0°, with reference to the tangent of the row of teeth in question, in such a manner that a liquid pressure is produced in the direction towards the center of the gear rim when rotation occurs, whereby the teeth are oriented in opposite directions in the case of gear rims driven to rotate opposite to one another.

The effectiveness of the above solution approach can be further increased in that a plurality of concentric rows of teeth is provided, in each instance, whereby a first group of rows of teeth acts as a rotor, and a second group of rows of teeth acts as a counter-current rotor that can be driven opposite to the rotor.

In order to further increase the effectiveness of the device that functions according to the above principle, it is particularly provided that in general, the teeth of both the inner and the outer rows of teeth produce a liquid pressure in the direction towards the center of the gear rim. In order to achieve this, a setting angle of the short block sides that differs from 90° is preferably provided for the teeth of the outer row of teeth. This angle can be dimensioned at about 45°, for example.

The teeth of the two rows of teeth of the counter-current rotor are preferably disposed offset in such a manner that an interstice of the teeth of the one row of teeth does not come to lie in the region of the teeth of the other row of teeth, in the radial direction. This measure, too, supports the production of the strongest possible pressure in the direction towards the center of the gear rim.

The teeth of at least one row of teeth of the rotor are preferably also disposed, with reference to the tangent of the row of teeth in question, at an angle that differs from 0°, in such a manner that a liquid pressure is generated in the direction towards the center of the rows of teeth, whereby the teeth of a row of teeth of the rotor are oriented in the opposite direction of a row of teeth of the counter-current rotor, when the counter-current rotor is driven in the direction opposite to the rotor, with reference to the tangent of the row of teeth in question.

In order to build up a radial pressure gradient that increases with the radius, by means of increased friction in the peripheral regions, the teeth of an inner row of teeth of the rotor are preferably disposed at a greater distance relative to one another, in each instance, than the teeth of an outer row of teeth. In this connection, a tooth is preferably configured essentially in block shape, whereby the distance between two adjacent teeth of a gear rim is dimensioned to be smaller than the length of a tooth.

In the device according to the invention, it has generally proven itself to firmly couple the inducer screw with one or more of the rows of teeth. In this connection, it can be provided, in particular, that the inducer screw and the counter-current rotor are configured as part of a compact unit, whereby the counter-current rotor is structured as a dual gear rim having two concentrically disposed rows of teeth. According to a very important preferred embodiment of the device according to the invention, it is provided, in this connection, that the teeth of at least one of the rows of teeth, preferably of the inner row of teeth, are disposed at an angle that differs from 0°, with reference to the tangent of the row of teeth in question, in such a manner that a liquid pressure is generated in the direction towards the center of the gear rim.

According to a preferred embodiment, the rotor contains three concentrically disposed rows of teeth, whereby a center row of teeth of the rotor is disposed between the two rows of teeth of the counter-current rotor, and the two other rows of teeth of the rotor flank the two rows of teeth of the counter-current rotor, towards the inside and the outside.

The processed substances can preferably be passed back into the container for iterative processing after they have passed through the processing unit, whereby return feed preferably takes place into the region of the container bottom.

Figure 2:
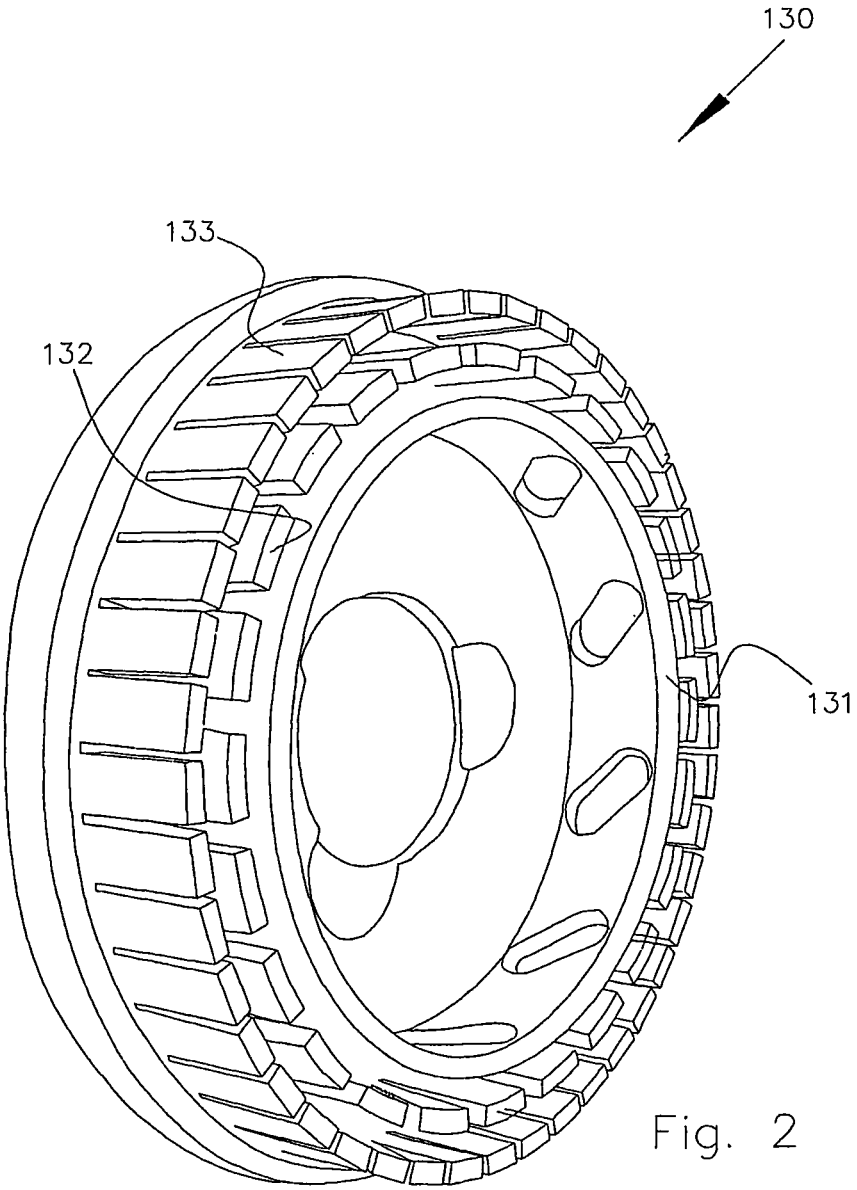
Figure 3:
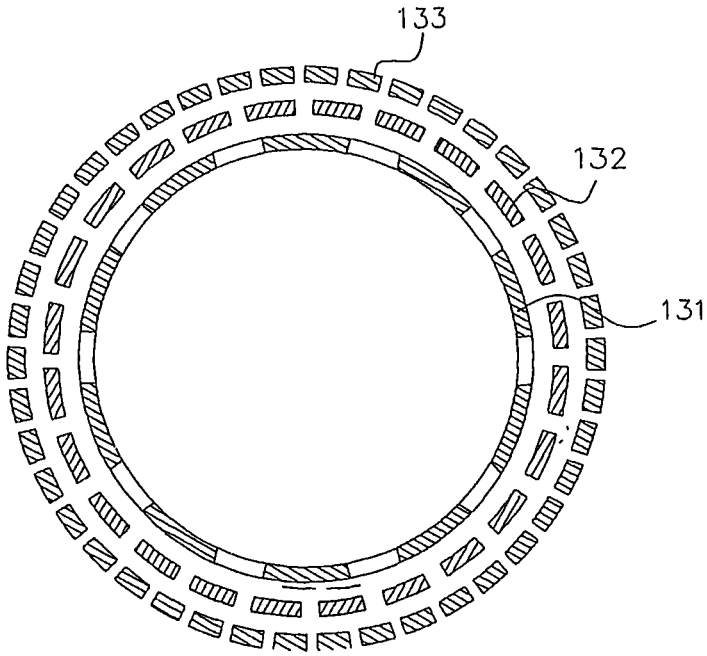
Figure 4:
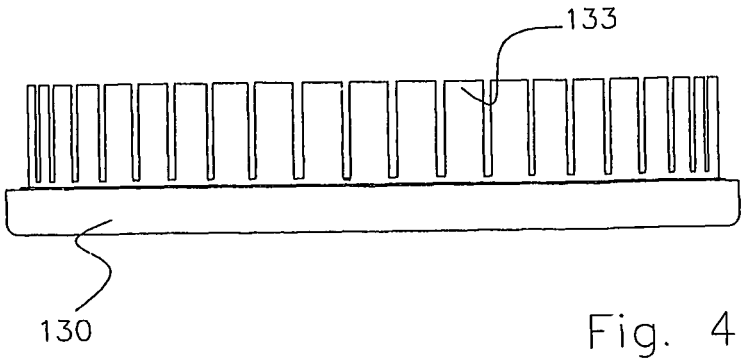
Figure 5:
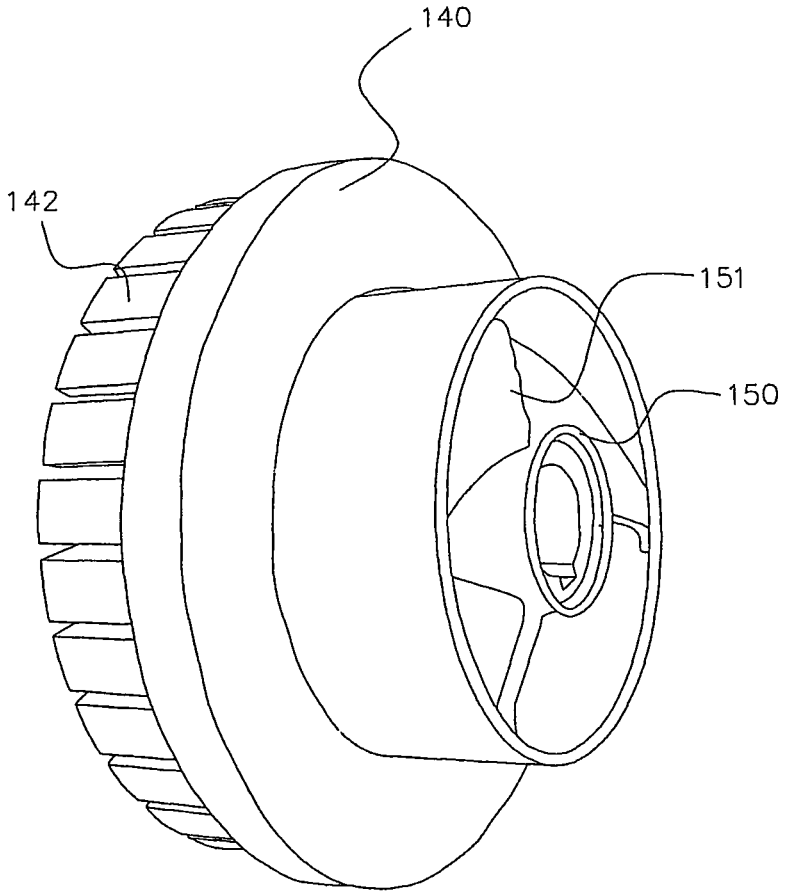
Figure 6:
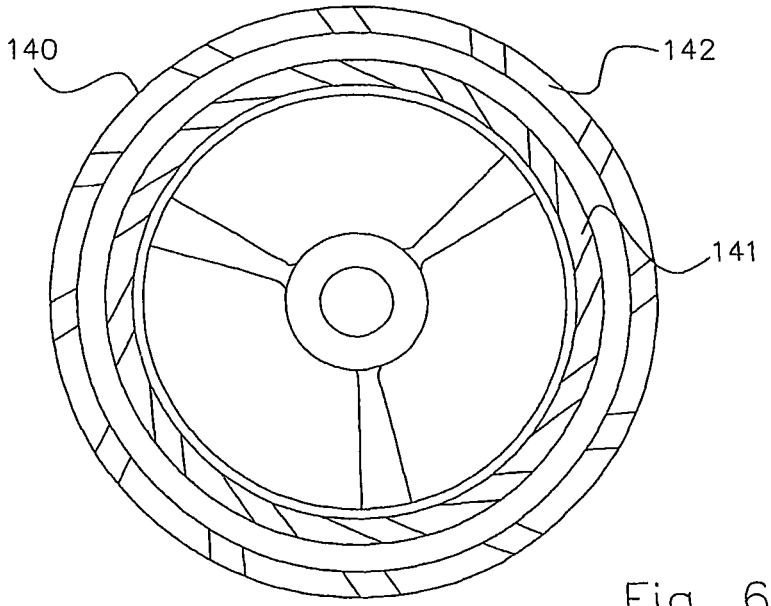
Figure 7:
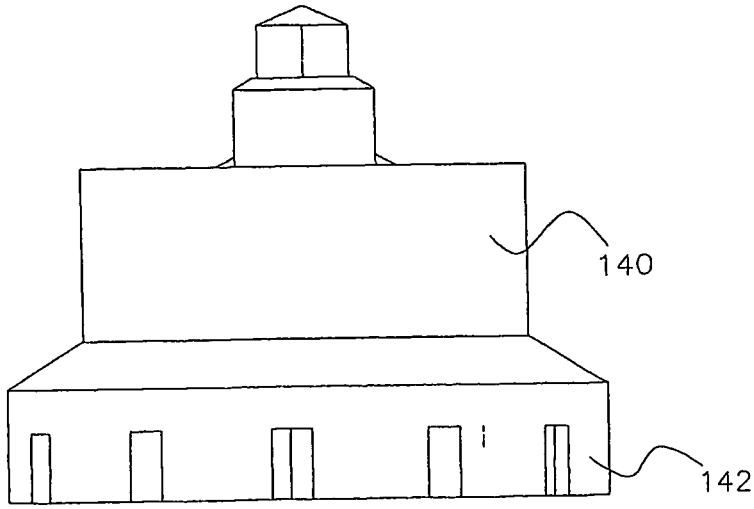
Figure 8:
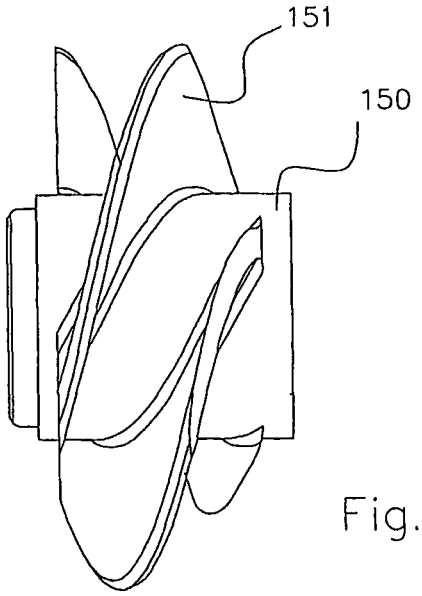
Figure 9:
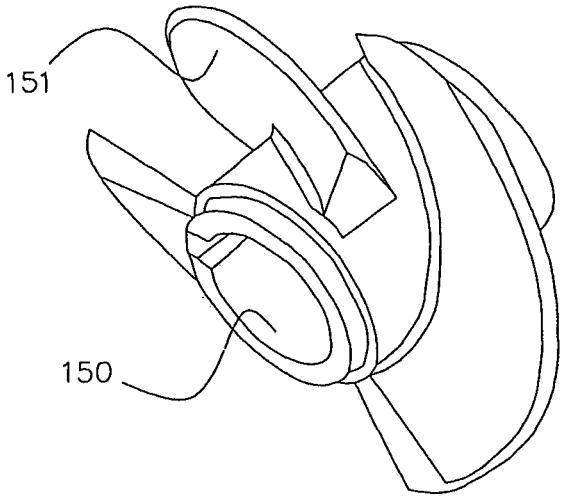

The device according to the invention will be explained in the following, using a preferred embodiment that is shown in the figures of the drawing. There, the figures show:

FIG. 1 a preferred exemplary embodiment of the homogenizer device according to the invention in a side view, partially broken open;

FIG. 2 the rotor of the homogenizer device according to the invention shown in FIG. 1 in a view at a slant from the top;

FIG. 3 the rotor of the homogenizer device according to the invention shown in FIG. 1 in a view from the bottom;

FIG. 4 the rotor of the homogenizer device according to the invention shown in FIG. 1 in a side view;

FIG. 5 an embodiment of the inducer with integrated counter-current rotor according to the embodiment of the device according to the invention shown in FIG. 1, in a view at a slant from the top;

FIG. 6 the embodiment of the counter-current rotor of the device according to the invention shown in FIG. 5, in a view from the bottom;

FIG. 7 the embodiment of the counter-current rotor of the device according to the invention shown in FIG. 5, in a side view;

FIG. 8 the embodiment of the inducer of the device according to the invention shown in FIG. 1, in a side view;

FIG. 9 the embodiment of the inducer of the device according to the invention shown in FIG. 1, in a view at a slant from above.

The homogenizer device 100 for dispensing and/or homogenizing liquid to viscous substances, shown in FIGS. 1 to 9, contains a container 110 having an opening, not shown, for introducing the substances to be processed. The container 110 has an opening for feeding the substances into a processing unit 120, in a central region of its bottom, which opening contains two gear rims 130, 140, which can be driven independent of one another, are disposed concentrically and configured in circular shape, and are separated from one another by way of a predetermined interstice, whereby the substances are guided from a central region, through the interstice, into a peripheral region of the gear rims 130, 140. It is essential to the invention that a conveyance device 150 is additionally provided in the processing unit 120, which device conveys the substances in the direction of the gear rims 130, 140, under pressure.

The conveyance device 150 is disposed upstream from the gear rims 130, 140, and is configured as an inducer screw 150 having three vanes 151 that partly overlap. In this connection, the vanes 151 overlap in an angle range of about 65° and have a pitch of about 30%.

In this connection, the inducer screw 150 is disposed within a hollow cylinder through which the substances to be processed pass.

The two gear crowns 130, 140 each have a plurality of concentric rows of teeth, whereby a first group of rows of teeth acts as a rotor 130, and a second group of rows of teeth acts as a counter-current rotor 140 that can be driven to rotate opposite to the rotor 130. In this connection, the counter-current rotor 140 comprises an inner 141 and an outer row of teeth 142, which are disposed concentric to one another.

The teeth of the inner row of teeth 141, in particular, are disposed at an angle that differs from 0°, with reference to the tangent of the row of teeth in question, in such a manner that a liquid pressure is produced in the direction towards the center of the gear rim when rotation occurs. The teeth of both the inner 141 and the outer row of teeth 142 generate a liquid pressure in the direction towards the center of the gear rim, whereby a setting angle of the short block sides that differs from 90° is provided for the teeth of the outer row of teeth 142, for this purpose.

The teeth of the two rows of teeth 141, 142 of the counter-current rotor 140 are disposed offset in such a manner that an interstice of the teeth of the one row of teeth does not come to lie in the region of the teeth of the other row of teeth, in the radial direction. The counter-current rotor 140 contains three rows of teeth disposed concentric to one another.

The teeth of the rows of teeth of the rotor 130 are disposed at an angle that differs from 0°, with reference to the tangent of the row of teeth in question, in such a manner that a liquid pressure is produced in the direction towards the center of the rows of teeth, whereby the teeth of a row of teeth of the rotor are oriented in the opposite direction of a row of teeth of the counter-current rotor, when the counter-current rotor 140 is driven in the direction opposite to the rotor 130, with reference to the tangent of the row of teeth in question. For this purpose, the teeth of an inner row of teeth 131 of the rotor 130 are disposed at a greater distance from one another than the teeth of an outer row of teeth, in each instance.

A tooth of the rows of teeth of the rotor 130 is configured essentially in block shape, whereby the distance between two adjacent teeth of a gear rim is dimensioned to be smaller than the length of a tooth.

The inducer screw 150 and the counter-current rotor 140 are configured as part of a compact unit, whereby the counter-current rotor 140 is structured as a dual gear rim having two rows of teeth 141, 142 disposed concentrically.

In the embodiment shown, the rotor 130 contains three rows of teeth 131, 132, 133 disposed concentrically, whereby a center row of teeth 132 of the rotor 130 is disposed between the two rows of teeth 141, 142 of the counter-current rotor 140, and the two other rows of teeth 131, 133 of the rotor 130 flank the two rows of teeth 141, 142 of the counter-current rotor 140, towards the inside and the outside.

The substances can be passed back into the container 110 for iterative processing after they have passed through the processing unit 120, whereby return feed takes place into the region of the bottom of the container 110.

The exemplary embodiment of the invention explained above merely serves the purpose of better understanding of the teaching according to the invention defined by the claims, which teaching is not restricted, as such, by the exemplary embodiment.

The invention claimed is:

1. A homogenizer device for dispersing and/or homogenizing liquid to viscous substances, having comprising:

a container having one or more openings for introducing the substances to be processed, which substances are mixed in the container to form a liquid to be processed, whereby the container has an opening;

a processing unit disposed in a central region of a bottom of the opening:

at least two gear rims, disposed at least partially in said opening of said container and which can be driven independent of one another, and which are disposed concentrically and configured in circular shape, and are separated from one another by way of a predetermined interstice, whereby the substances are guided from a central region, through the interstice, into a peripheral region of the gear rims;

a conveyance device disposed upstream from the gear rims disposed in the processing unit, which device conveys the liquid in a direction of the gear rims, under pressure, whereby the conveyance device is configured as an inducer screw comprising:

two to four partly overlapping vanes;

wherein at least one of the at least two gear rims comprises a counter-current rotor comprising an inner and an outer row of teeth, which are disposed concentric to one another, and the teeth of at least one of the rows of teeth of the counter-current rotor are disposed at an angle that differs from 0 degree, with reference to a tangent of the other row of teeth, in such a manner that a liquid pressure is produced in a direction towards the row of teeth that is located in a center of the gear rim;

wherein the two gear rims each have a plurality of concentric rows of teeth, whereby a first group of rows of teeth acts as a rotor, and a second group of rows of teeth acts as a counter-current rotor that can be driven to rotate opposite to the rotor;

wherein one or more of the rows of teeth of the counter-current rotor is positioned above the rows of teeth of the rotor and firmly coupled to the inducer screw.

2. The device according to claim 1, wherein three partly overlapping vanes are provided.

3. The device according to claim 2, wherein the vanes overlap in an angle range of 50 degree to 80 degree.

4. The device according to claim 3, wherein the vanes overlap in an angle range of 65 degree.

5. The device according to claim 1, wherein the vanes have a pitch of about 20% to 40%.

6. The device according to claim 5, wherein the vanes have a pitch of about 30%.

7. The device according to claim 1, wherein the inducer screw is disposed within a hollow cylinder, through which the substances to be processed pass.

8. The device according to claim 1, wherein the teeth of the inner row of teeth are disposed at an angle that differs from 0 degree, with reference to a tangent of the outer row of teeth, in such a manner that a liquid pressure is produced in a direction towards a center of at least one gear rim of said at least two gear rims when rotation occurs.

9. The device according to claim 1, wherein the teeth of the inner and the outer rows of teeth produce a liquid pressure in a direction towards a center of at least one gear rim of said at least two gear rims.

10. The device according to claim 1, wherein the outer row of teeth have a setting angle that differs from 90 degrees.

11. The device according to claim 1, wherein the teeth of said inner row of teeth and said outer row of teeth of the counter-current rotor are disposed offset to one another in such a manner that an interstice of the teeth of the one row of teeth does not come to lie in a region of the teeth of another row of teeth, in a radial direction.

12. The device according to claim 1, wherein the counter-current rotor comprises three rows of teeth disposed concentrically to one another.

13. The device according to claim 1, wherein the teeth of at least one of the rows of teeth of the rotor are disposed, with reference to a tangent of another row of teeth of the first group, at an angle that differs from 0 degree, in such a manner that a liquid pressure is generated in a direction towards the row of teeth that is located on a center of the rotor, whereby the teeth of a row of teeth of the rotor are oriented in an opposite direction of a row of teeth of the counter-current rotor, when the counter-current rotor is driven in a direction opposite to the rotor.

14. The device according to claim 1, wherein a set of teeth of an inner row of teeth of the rotor are disposed at a greater distance relative to one another, in each instance, than a set of teeth of an outer row of teeth of the rotor.

15. The device according to claim 12, wherein a tooth is configured in block shape, whereby a distance between two adjacent teeth of a gear rim is dimensioned to be smaller than a length of a tooth.

16. The device according to claim 1, wherein the inducer screw and the counter-current rotor are configured as part of a compact unit, whereby the counter-current rotor is structured as a dual gear rim having two concentrically disposed rows of teeth.

17. The device according to claim 12, wherein three concentrically disposed rows of teeth of the rotor are disposed in such a manner that a center row of teeth of the rotor is disposed between two other rows of teeth of the counter-current rotor.

18. The device according to claim 1, wherein the substances can be passed back into the container for iterative processing after they have passed through the processing unit.

19. The device according to claim 18, wherein return feed takes place into region of bottom of the container.

* * * * *

UNITED STATES PATENT AND TRADEMARK OFFICE

CERTIFICATE OF CORRECTION

PATENT NO. : 8,721,168 B2
APPLICATION NO. : 12/085275
DATED : May 13, 2014
INVENTOR(S) : Nadler et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1481 days.

Signed and Sealed this
Twenty-ninth Day of September, 2015

Michelle K. Lee

Michelle K. Lee
*Director of the United States Patent and Trademark Office*